US005839212A

United States Patent [19]

Brinker

[11] Patent Number: 5,839,212

[45] Date of Patent: Nov. 24, 1998

[54] EJECTOR APPARATUS FOR AN EARTH MOVING SCRAPER BOWL

[75] Inventor: Lee J. Brinker, Beloit, Kans.

[73] Assignee: Kan-Am Industries, Inc,, Beloit, Kans.

[21] Appl. No.: 789,337

[22] Filed: Jan. 27, 1997

[51] Int. Cl.[6] ..... E02F 03/64

[52] U.S. Cl. ..... 37/416; 37/901; 37/431; 37/427; 127/634.5

[58] Field of Search ..... 37/901, 435, 398, 37/416, 436, 444, 445, 411, 415, 421, 427, 431; 172/811, 737, 684.5, 815, 445.1, 669, 799.5

[56] References Cited

U.S. PATENT DOCUMENTS

| | | | |
|---|---|---|---|
| 3,122,248 | 2/1964 | Campbell et al. | 37/901 X |
| 4,255,885 | 3/1981 | Mitchell et al. | 37/416 |
| 4,308,677 | 1/1982 | Behm | 37/416 |
| 4,366,635 | 1/1983 | Joyce, Jr. | 37/416 |
| 5,603,382 | 2/1997 | Mciver | 37/901 X |

FOREIGN PATENT DOCUMENTS

| | | | |
|---|---|---|---|
| 2448002 | 8/1980 | France | 37/901 |
| 67219 | 7/1948 | Germany | 37/901 |
| 1086078 | 4/1984 | U.S.S.R. | 37/901 |
| 2064473 | 6/1981 | United Kingdom | 37/901 |

*Primary Examiner*—Terry Lee Melius
*Assistant Examiner*—Victor Batson
*Attorney, Agent, or Firm*—Litman, McMahon, & Brown, L.L.C.

[57] ABSTRACT

A pair of links disposed at opposite sides and rearwardly of a scraper ejector panel pivotly support the panel from the upper limit of the bowl side walls and maintain it in substantially upright position as it moves forwardly in a downward arcuate path of its lower limit adjacent the scraper bowl bottom. In the retracted position the ejector panel forms a rearward wall for the scraper bowl.

4 Claims, 4 Drawing Sheets

EJECTOR APPARATUS FOR AN EARTH MOVING SCRAPER BOWL

BACKGROUND OF THE INVENTION

This invention relates to earth moving scrapers of the load ejector type and more particularly to an ejector apparatus which provides efficient and complete ejection of the load in the scraper bowl.

Earth moving scrapers generally comprise a bucket or bowl having upstanding parallel side walls rigidly secured to a bottom wall which forms an open front end through which soil passes to load the bowl. The bottom wall is provided with a forwardly extending blade which cuts and loosens soil when the bowl is in a lower generally horizontal earth contacting position. An ejector panel is supported between the bowl walls and extends from one wall to the other adjacent the plane of the bottom wall to permit the ejector panel to be moved from a rearward soil loading position to a forward load ejecting position as the scraper is moved forwardly.

The scraper is towed by a prime mover and is wheel supported at its rearward end. Hydraulic actuators permit the bowl to be raised to an upward position for transporting soil and then lowered to its horizontal position for loading the bowl. It has been the practice to support the ejector panel on the bowl bottom by rollers and move it forward and rearwardly by hydraulic actuators. This type of ejector panel mounting has not always proved satisfactory for the reason one side or the other of the ejector panel may be moved forwardly of synchronization with the opposite or other side and thus bind the ejector panel between the bowl walls. This invention provides ejector panel supporting links mounted on respective side walls of the bowl rearwardly of the ejector panel and swingably mounting the ejector panel therebetween.

SUMMARY OF THE INVENTION

An earth moving scraper having a bowl frame is supported at its forward end by a prime mover hitch and is supported at its rearward end by wheels on a wheel frame pivotly connected with the rearward limit of the bowl frame on a horizontal axis. The bowl comprises a bottom wall having rigidly interconnected side walls defining an open front and an open rearward end. The bowl bottom wall is provided with a cutting blade for cutting earth when the bowl is lowered to a generally horizontal position adjacent the surface of the earth. The bowl rearward opening is normally closed by an ejector panel extending transversely between the side walls and pivotly connected with the side walls by pairs of links permitting horizontal swinging movement of the ejector panel in which the lower limit of the ejector panel describes an arc of a circle during its forward and rearward movement. The bottom wall of the bowl being similarly arcuately bowed downwardly between its forward and rearward limits on a radius slightly greater than the radius of the arc described by the lower limit of the ejector panel.

In its swinging movement during earth ejecting movement an apron extending transversely between the side walls at their forward end portions coacts with the blade at the forward end of the bowl bottom wall to form a transverse aperture limiting the amount of soil discharged from the bowl in the load ejecting movement of the ejector panel.

The principal object of this invention is to provide a scraper in which the ejector panel is prevented from binding contact with the bowl side walls or its bottom.

DESCRIPTION OF PREFERRED EMBODIMENTS

Figure 1:
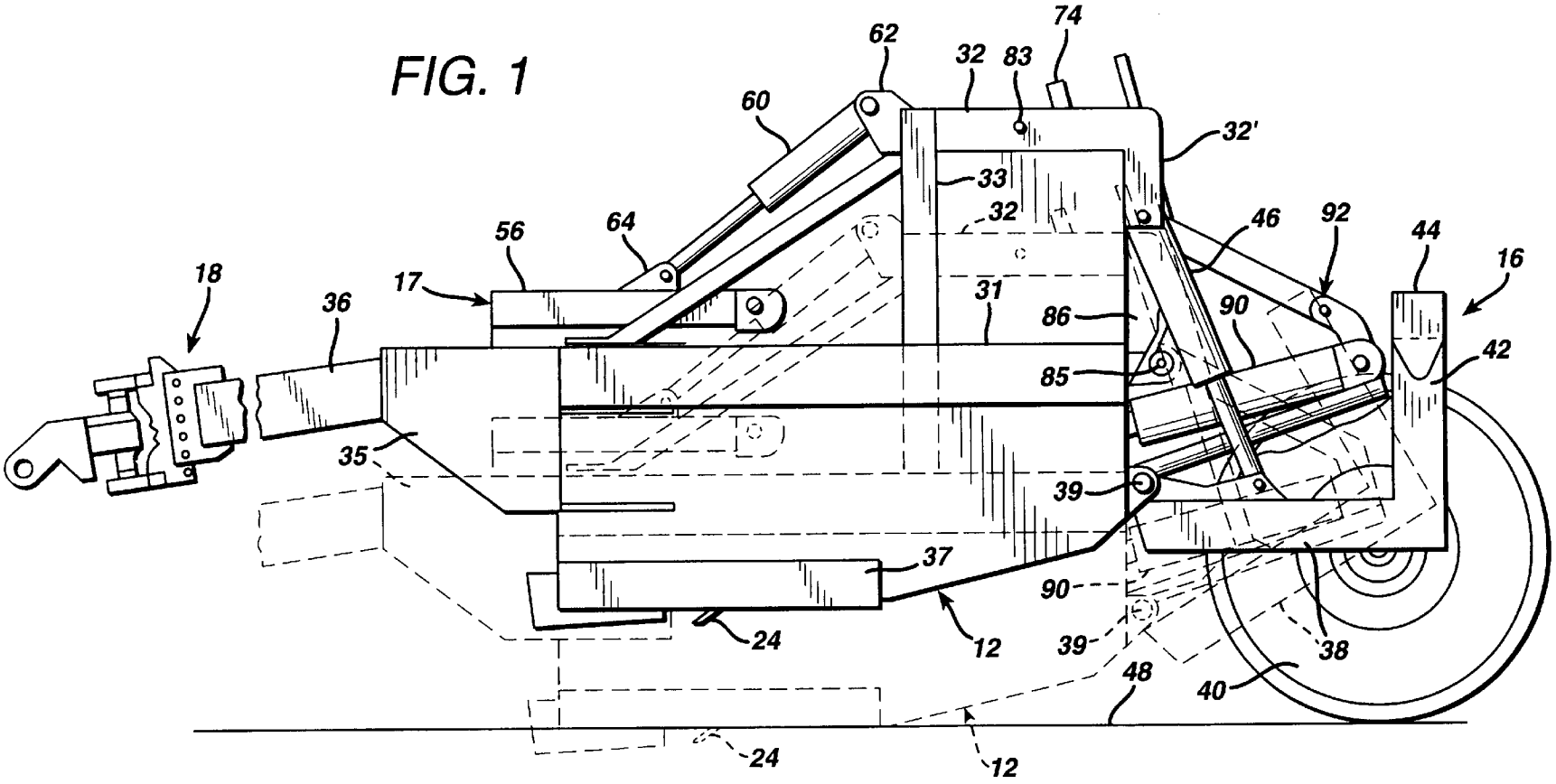
FIG. 1 is a side elevational view illustrating by dash lines the bowl loading position.

Like characters of reference designate like parts in those figures of the drawings in which they occur.

In the drawings:

The reference numeral 10 indicates an earth moving scraper formed by a rigid frame and bowl structure 12 having a load ejection means 14 within the bowl; a wheel and frame means 16 for supporting the rearward end of the bowl structure; a pivoting apron means 17 for opening and closing the forward end of the bowl; and, a hitch means 18 for connection with a prime mover such as a tractor (not shown) for moving the earth scraper 10. The earth scraper 10 further includes a plurality of conduits and hose connected with a suitable fluid power supply (not shown) on the tractor for operating pressure actuators such as hydraulic cylinders, as will presently be explained.

The bowl and frame structure 12 comprises a bottom wall 20 secured at its rearward limit to a frame beam 22 extending transversely coextensive with the rearward limit of the bottom wall 20 soil cutting blade 24 secured to its forward limit in forwardly projecting down turned relation. The bottom wall 20 forward end portion is substantially horizontal and the remaining rearwardly extending portion is inclined upwardly and is arcuately bowed downwardly on a selected radius between its forward and rearward limits to form an arcuate concave surface 26.

Upstanding side walls 28 and 30 are rigidly secured to opposite sides of the bowl bottom 20. Horizontal and vertical side beams 31, 32 and 33 are secured to the outer surfaces of the walls 28 and 30. A forward transverse frame beam 34 and forward side plates 35 and 37 secured to the forward end portions of the side walls 28 and 30 prevent spreading of the walls during soil loading action as presently explained. A tongue 36 connects the hitch member 18 with the forward frame members 34 and 35.

The wheel frame means 16 comprises a plurality of normally horizontal axle support bars 38 pivotly connected at their forward end portions to a transverse shaft 39 supported by plates secured to the bowl bottom wall cross beam support 22 and journal, at their rearward end portions, the axles of a plurality of wheels 40 (only one being shown). The frame means 16 further includes a plurality of standards 42 rigidly secured at their depending ends to the rearward end portion of the axle support bars 38 in orthogonal relation. The upper end portion of the standards 42, projecting above the plurality of wheels 40, are interconnected by a coextensive box beam 44. A pair of actuators 46 are connected at one end with a depending leg 32' of the side wall top cross beams 32 and an intermediate portion of the outermost axle support bar 38 for pivoting the wheel frame 16 relative to the bowl structure 12 to lower the latter to the surface of the earth 48 in a soil cutting and pick-up action as presently explained and as illustrated by dash lines (FIG. 1).

The front apron means 17 cooperates with the bowl structure 12 in retaining a load of earth therein and comprises an arcuate center plate 50 having a rearward depending edge 52, which abuts the cutter blade 24 when in load retaining position, terminating at its upper limit substantially in the plane of the upper limit of the side beams 31. A pair of apron side plates 54 are secured to respective sides of the apron 50 inwardly of the bowl side walls 28 and 30. A pair of apron lift arms 56 are secured to the upper limit of the respective apron side plate 54 and are pivotly connected with the bowl side plates 28 and 30 by pins 58 for vertical pivoting movement of the apron means 17 in opening and closing the forward end of the bowl 12. This is accomplished by a pair of apron actuators 60 interposed between lugs 62 on the bowl top side beams 32 and a pair of lugs 64 secured to the respective apron lift arm 56.

Figure 2:
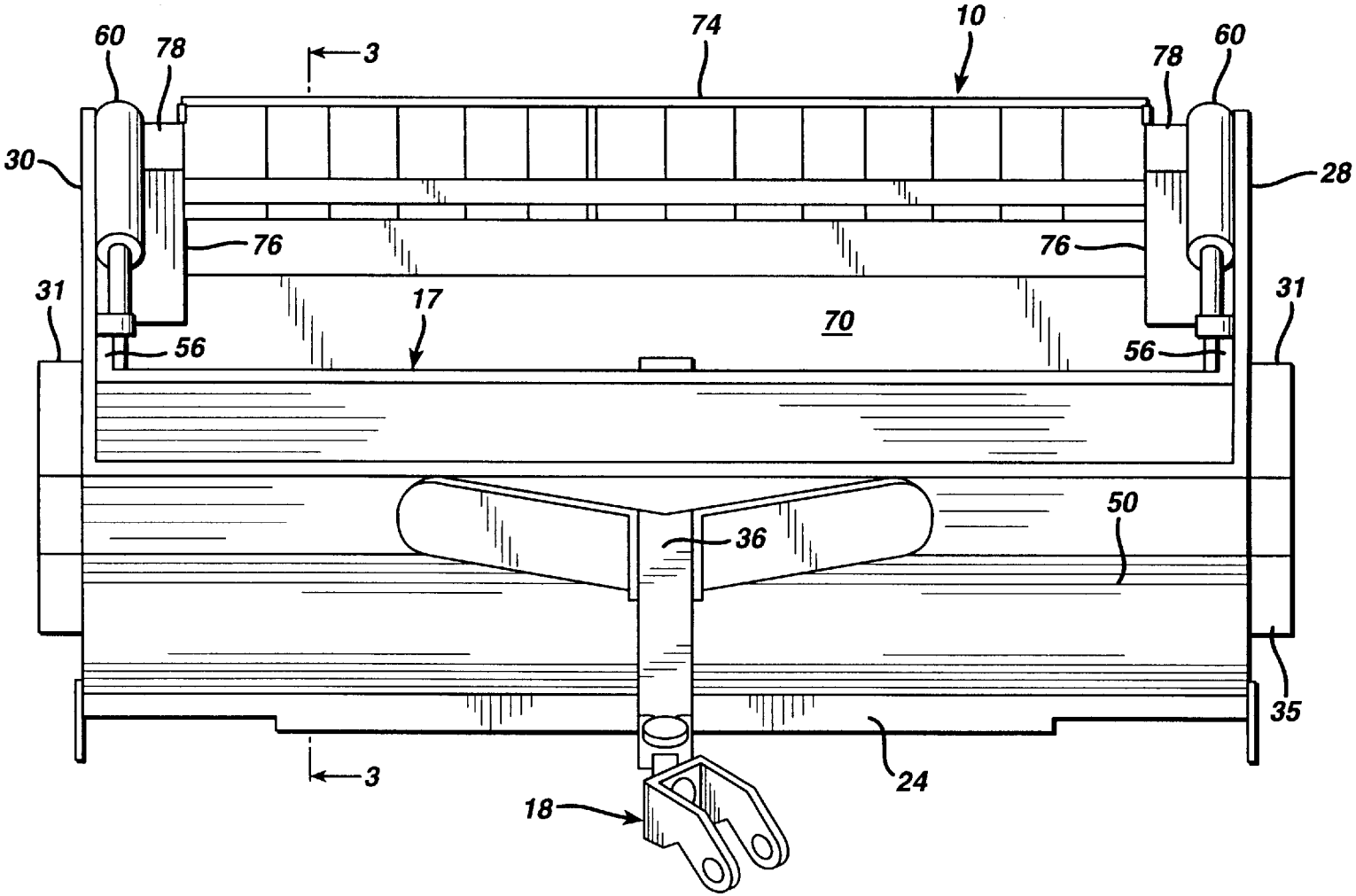
FIG. 2 is a front elevational view.
Figure 3:
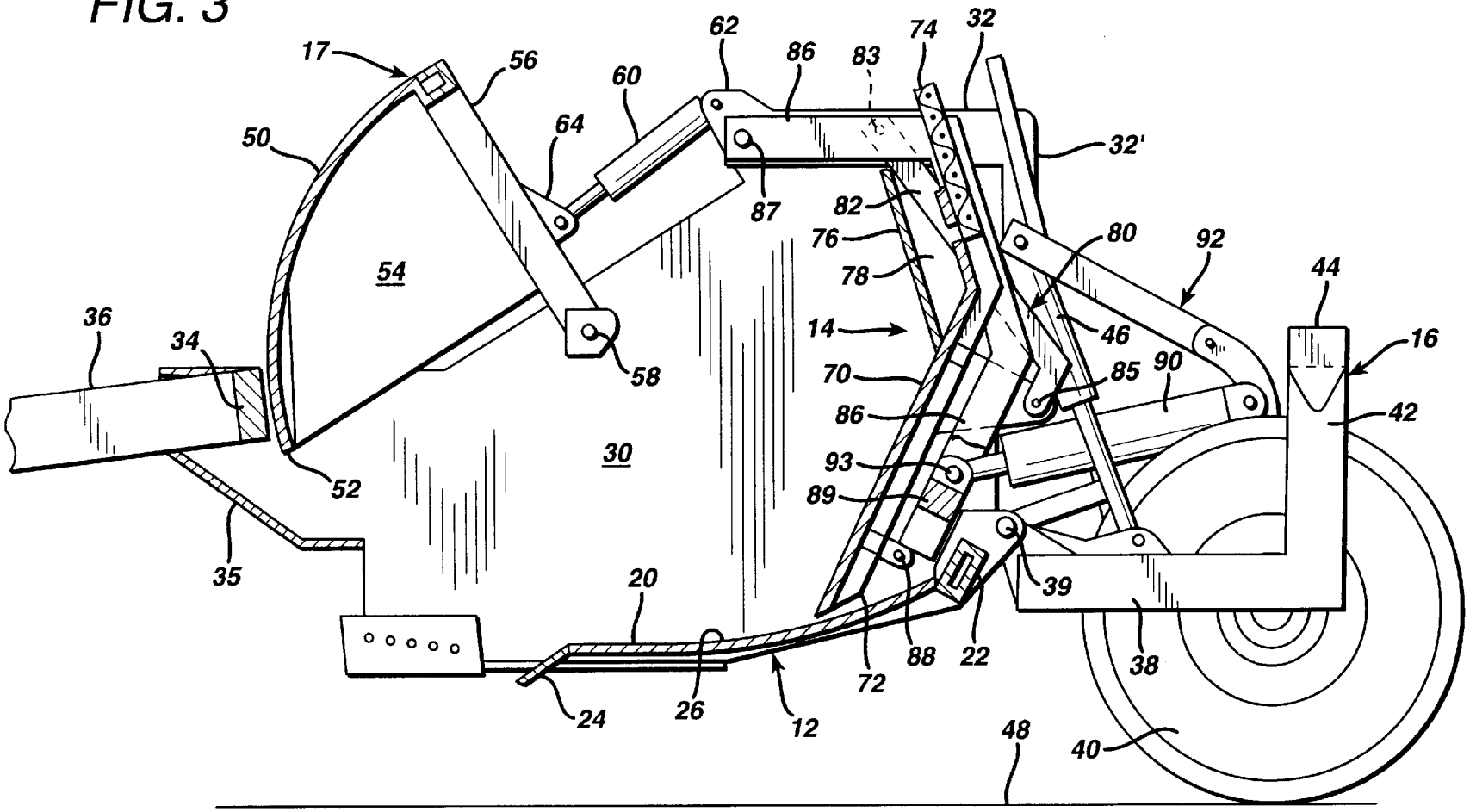
FIG. 3 is a vertical cross-section view to a larger scale partly in elevation illustrating the ejector panel in retracted position taken substantially along the line 3—3 of FIG. 2; and, FIG. 4 is a view similar to FIG. 3 illustrating the ejector panel in its forward position.

The ejector means 14 comprises a first or lower ejector panel 70 extending between the bowl side walls 28 and 30 normally closing the rearward opening of the bowl when in a retracted position. The panel 70 has a forward planar face and its rearward or opposite surface is reinforced by box tubing 72. A screen or second panel 74 is inclined forwardly and extends upwardly from the upper limit of the bottom panel 70 to prevent soil being pushed over the rearward upper limit of the panel 70 during bowl loading operation. The screen panel 74 terminates at its respective sides, inwardly of the respective sides of the bottom panel 70 (FIG. 2). An L-shaped wall 76 at each end of the screen panel is secured thereto and to the upper limit of the bottom panel 70 to form an upwardly and laterally open recess 78 at each end of the screen panel above the lower panel 70 for nesting the upper end portion of pairs of ejector panel supporting link means 80, at each side of the panel 70, when the ejector means 14 is in the retracted position (FIG. 3).

The two pairs of link means 80 are identical with each other and only one pair is described in the interest of brevity. The link means 80 comprises a first or support link 82 pivotly connected at its upper end by a pin 83 substantially medially the length of the bowl top side beam 32 and pivotly connected to a rearwardly projecting lug 84 on the adjacent upper side limit of the panel 70 by a pin 85 for vertical pivoting movement of the lower end portion of the link 82 about the axis of the pin 83. A second ejector support and push off link 86, substantially dog-leg-like in side elevation, is pivotly connected at its upward end portion by a pin 87 to the side wall lug 62 and pivotly connected at its depending end to the adjacent side edge of the rearward lower limit of the ejector panel 70 by a pin 88. A link push off actuator 90 is pivotly connected at one end to an actuator support frame 92, projecting rearwardly and upwardly from the rearward end of the bowl 12 medially its width and between a pair of the wheels 40 and extends forwardly and is connected by its rod portion to a cross brace 89 extending between the depending end portions of the second links 86 by a pin 93.

OPERATION

Figure 4:
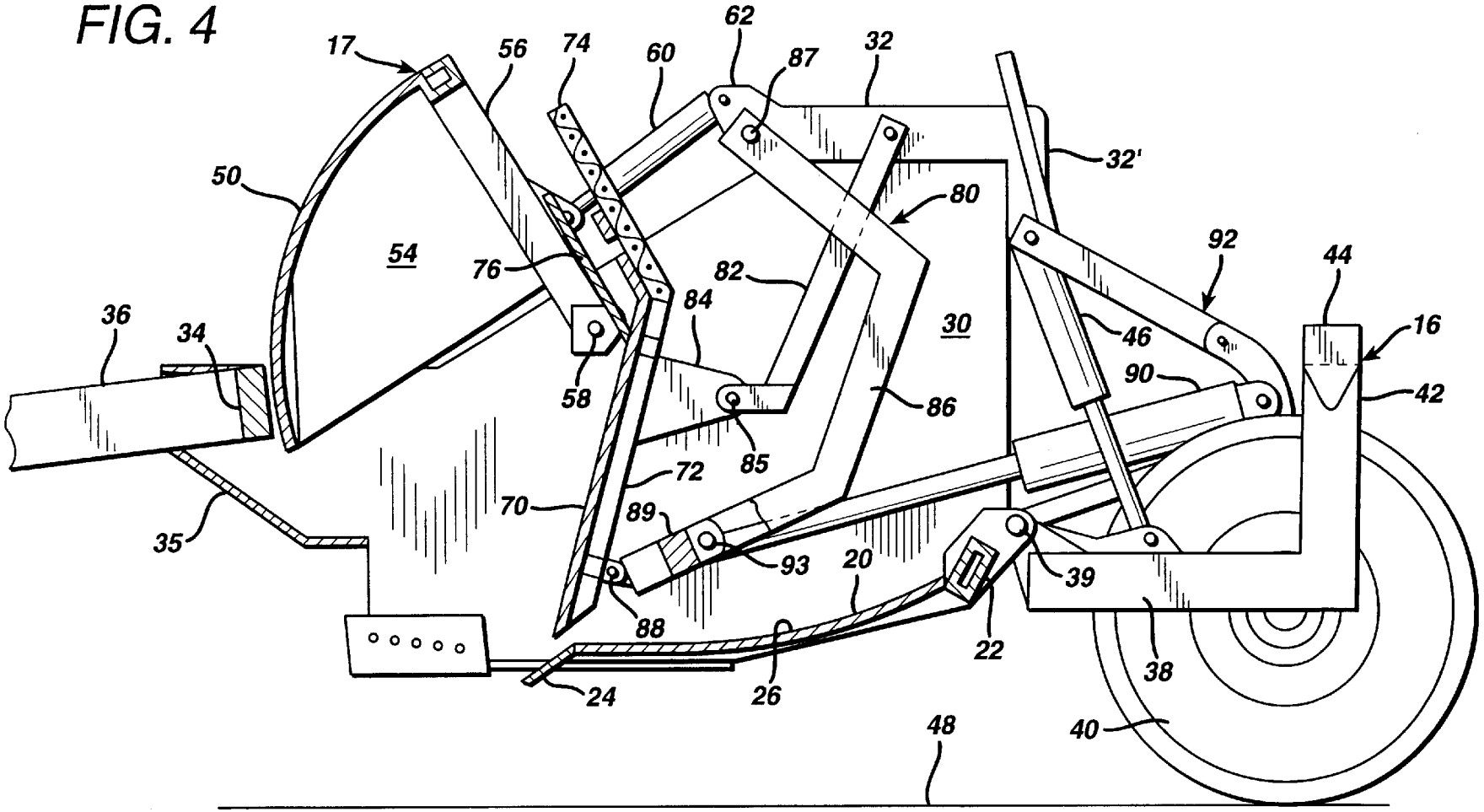

In operation the bowl 12 is filled with soil in a manner substantially conventional with earth scrapers of this type and briefly stated comprises moving the apparatus 10 in a forward direction with the apron means 17 raised to its upward position as illustrated by FIG. 4 while simultaneously lowering the bowl for the blade 24 to engage the surface of the earth 48 by operating the wheel frame pivoting actuators 46 to pivot the wheel frame 16 about the axis of the shaft 39 disposing the bowl structure 12 and the wheel frame means 16 in the dashed line position of FIG. 1. When the bowl is loaded with a desired quantity of earth (not shown) the apparatus 10 is moved to a place for dumping or unloading the earth. With the apron means 17 in the lifted position or, with its rearward edge 52 disposed in selected spaced relation with respect to the cutting blade 24 for controlling the quantity of earth being moved through the open end of the bowl, the ejector means 14 is moved forwardly by the push off actuator 90 extending its piston rod. The depending edge of the panel 70 moves in a path adjacent and complemental with the concave upper surface 26 of the bowl bottom 20, thus moving bowl contained earth out the forward end of the bowl until the ejector and link means 80 reach the position illustrated by FIG. 4. After discharging the load the actuator 90 is operated to return the links and ejector panels to the retracted position (FIG. 3) completing one cycle of operation.

Obviously the invention is susceptible to changes or alterations without defeating its practicability. Therefore, I do not wish to be confined to the preferred embodiments shown in the drawings and described herein.

I claim:

1. In an earth mover having a bowl structure including a bottom wall having forward and rearward limits and inclined rearwardly and upwardly from a forward marginal horizontal portion and rigidly interconnecting laterally spaced side walls and having an earth cutting forward end edge and arcuately bowed downwardly on a predetermined radius forming a bottom wall surface between its forward and rearward limits, and having a rearward support frame, the improvement comprising:

a side beam at the upper limit of each said side wall;

a lug on each said side beam;

means including a generally upright ejector panel having a depending edge adjacent the bowl arcuate bottom wall surface and extending transversely between said side walls;

means supporting said ejector panel means for vertical swinging movement between a rearwardly retracted position serving as a rear wall for said bowl structure and a forward bowl load ejection position comprising;

a first pair of elongated links pivotally connected at one end portion, respectively, with said side beams and respectively pivotally connected in horizontal spaced relation by the respective other end portion of each link of said pair of links with respective adjacent side edge portions of said ejector panel means; and, extensible and retractable actuator means operatively connected with said ejector panel means for reciprocating the ejector panel means between forward and rearward limits of said bottom wall.

2. The earth mover according to claim 1 in which said ejector panel means comprises:

a lower planar panel; and, an upper screen panel spaced inwardly with respect to the respective adjacent side wall and inclined forwardly and upwardly with respect to said lower panel.

3. The earth mover according to claim 2 in which the depending edge of said ejector panel means describes an arcuate path in close spaced relation with respect to the adjacent downwardly bowed arcuate surface of said bottom wall.

4. The earth mover according to claim 1 in which the supporting means further includes:

a second pair of links extending between and respectively pivotally connected, at respective end portions, with said lugs and the lowermost lateral edge portions of said ejector panel means.

* * * * *